US008052264B2

(12) United States Patent
Hays et al.

(10) Patent No.: US 8,052,264 B2
(45) Date of Patent: Nov. 8, 2011

(54) MELTING DEVICE FOR INCREASED PRODUCTION OF MELTED INK IN A SOLID INK PRINTER

(75) Inventors: Andrew Wayne Hays, Fairport, NY (US); Michael F. Leo, Penfield, NY (US); Roger G. Leighton, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 896 days.

(21) Appl. No.: 12/056,102

(22) Filed: Mar. 26, 2008

(65) Prior Publication Data

US 2009/0244225 A1 Oct. 1, 2009

(51) Int. Cl.
*B41J 2/175* (2006.01)

(52) U.S. Cl. ..... 347/88; 347/99

(58) Field of Classification Search ..... 347/88, 347/99

See application file for complete search history.

(56) References Cited

U.S. PATENT DOCUMENTS

| | | | | |
|---|---|---|---|---|
| 4,943,818 | A * | 7/1990 | Hotomi | 347/55 |
| 5,276,468 | A | 1/1994 | Deur et al. | |
| 5,489,925 | A | 2/1996 | Brooks et al. | |
| 5,699,095 | A | 12/1997 | Mitsuzawa et al. | |
| 5,784,089 | A | 7/1998 | Crawford | |
| 5,920,332 | A | 7/1999 | Brooks | |
| 6,024,433 | A | 2/2000 | Tsurui et al. | |
| 6,089,686 | A | 7/2000 | Thornton et al. | |
| 6,116,726 | A | 9/2000 | Driggers | |
| 6,422,694 | B1 | 7/2002 | Hollands | |
| 6,530,655 | B2 | 3/2003 | Jones et al. | |
| 6,601,950 | B2 | 8/2003 | Hollands et al. | |
| 6,880,911 | B2 | 4/2005 | Suzuki et al. | |
| 6,905,201 | B2 | 6/2005 | Leighton | |

FOREIGN PATENT DOCUMENTS

JP 03205158 A * 9/1991

* cited by examiner

*Primary Examiner* — Matthew Luu
*Assistant Examiner* — Rut Patel
(74) *Attorney, Agent, or Firm* — Maginot, Moore & Beck LLP

(57) ABSTRACT

A solid ink printer is enabled to eject ink onto image substrates at rates that are greater than previously known solid ink printers. The solid ink printer includes a print head that ejects melted ink, a web of image substrate that moves past the print head to receive melted ink ejected from the print head, a pair of fixing rollers positioned downstream of the print head, the fixing rollers forming a nip through which the web of image substrate passes to fix the ink onto the web of image substrate, and a melting device coupled to the print head to provide melted ink to the print head. The melting device includes a housing having an opening to receive solid ink, a first rotatable member mounted within the housing, a second rotatable member mounted with the housing, the second rotatable member being proximate to, but spatially separated from the first rotatable member mounted within the melting housing, a heater located within the first rotatable member to heat the first rotatable member to a temperature at which the solid ink melts; and a motor coupled to the first rotatable member and the second rotatable member to rotate the first rotatable member and the second rotatable member within the housing to shear the solid ink as the solid ink melts against the heated first rotatable member.

22 Claims, 4 Drawing Sheets

MELTING DEVICE FOR INCREASED PRODUCTION OF MELTED INK IN A SOLID INK PRINTER

TECHNICAL FIELD

The solid ink melting device disclosed below generally relates to solid ink printers, and, more particularly, to solid ink printers that require high rates of melted ink production.

Solid ink or phase change ink imaging devices, hereafter called solid ink printers, encompass various imaging devices, such as printers and multi-function devices. These printers offer many advantages over other types of image generating devices, such as laser and aqueous inkjet imaging devices. Solid ink or phase change ink printers conventionally receive ink in a solid form, either as pellets or as ink sticks. A color printer typically uses four colors of ink (yellow, cyan, magenta, and black).

The solid ink pellets or ink sticks, hereafter referred to as ink, sticks, or ink sticks, are delivered to a melting device, which is typically coupled to an ink loader, for conversion of the solid ink to a liquid. A typical ink loader includes multiple feed channels, one for each color of ink used in the imaging device. Each channel has an insertion opening in which ink sticks of a particular color are placed and then either gravity fed or urged by a conveyor or a spring-loaded pusher along the feed channel. Each feed channel directs the solid ink within the channel towards a melting device located at the end of the channel. Each melting device receives solid ink from the feed channel to which the melting device is connected and heats the solid ink impinging on it to convert the solid ink into liquid ink that is delivered to a print head for jetting onto a recording medium or intermediate transfer surface.

As the number of pages printed per minute increases for solid ink printers so does the demand for ink in the printer. To supply larger amounts of solid ink, the cross-sectional area of the feed channels may be increased. Of course, enlarging the feed channels results in greater amounts of ink being presented to the melting device. If the melting device is unable to melt the solid ink quickly enough, the melted ink supply may be depleted by the print head coupled to the melted ink reservoir. Ensuring solid ink is melted at a rate adequate to maintain an appropriate level of melted ink in the supply reservoir is important.

SUMMARY

A solid ink printer is enabled to eject ink onto image substrates at rates that are greater than previously known solid ink printers. The solid ink printer includes a print head that ejects melted ink, a web of image substrate that moves past the print head to receive melted ink ejected from the print head, a pair of fixing rollers positioned downstream of the print head, the fixing rollers forming a nip through which the web of image substrate passes to fix the ink onto the web of image substrate, and a melting device coupled to the print head to provide melted ink to the print head. The melting device includes a housing having an opening to receive solid ink, a first rotatable member mounted within the housing, a second rotatable member mounted with the housing, the second rotatable member being proximate to, but spatially separated from the first rotatable member mounted within the melting housing, a heater located within the first rotatable member to heat the first rotatable member to a temperature at which the solid ink melts; and a motor coupled to the first rotatable member and the second rotatable member to rotate the first rotatable member and the second rotatable member within the housing to shear the solid ink as the solid ink melts against the heated first rotatable member.

A solid ink printer may be configured to implement a method for melting solid ink with a solid ink melting device. The method includes heating two intermeshing members to a solid ink melting temperature, rotating the two intermeshing members, directing solid ink into a meshing zone formed between the two rotating intermeshing members, collecting the melted solid ink, and supplying the melted solid ink to at least one printhead in a solid ink printer.

BRIEF DESCRIPTION OF THE DRAWINGS

Features for a melting device used in a solid ink printer are discussed with reference to the drawings, in which.

DETAILED DESCRIPTION

Figure 1:
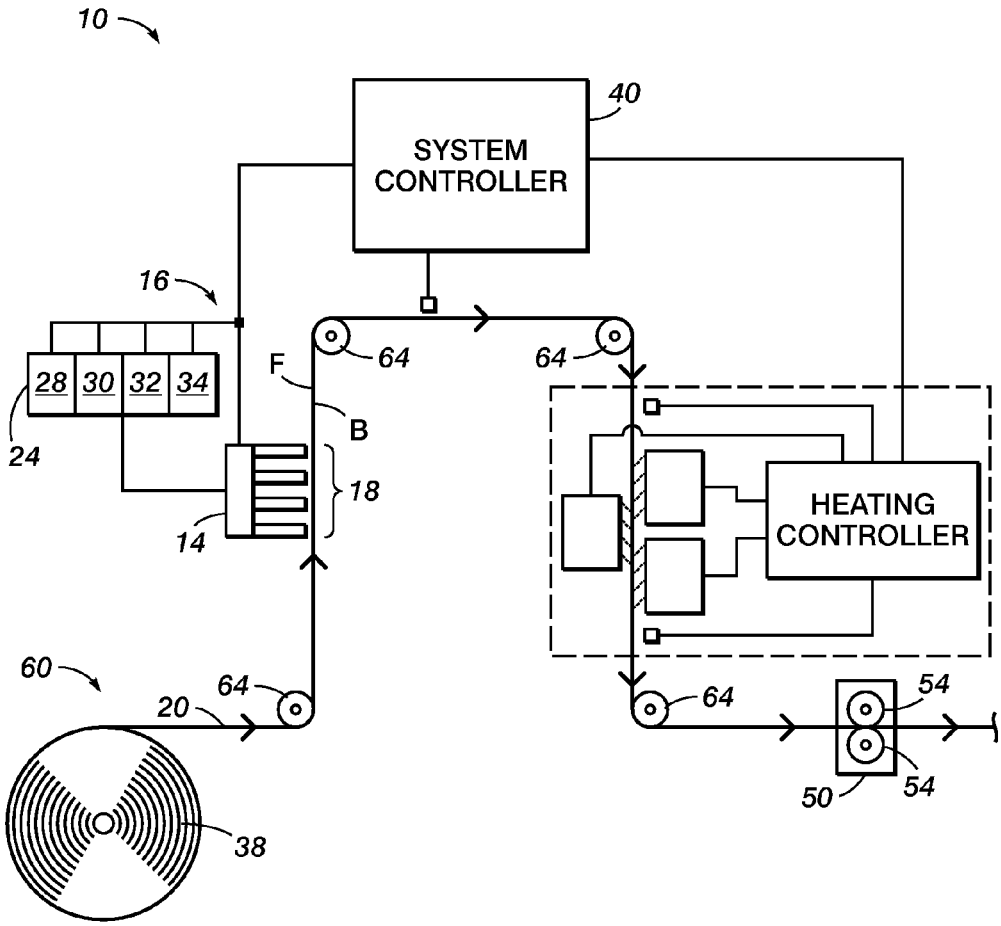
FIG. 1 is a perspective view of a solid ink printer in which the melting device of FIG. 2 may be used.

The term "printer" refers, for example, to reproduction devices in general, such as printers, facsimile machines, copiers, and related multi-function products. While the specification focuses on a device that melts solid ink at higher rates than previously known, the melting device may be used with any solid ink image generating device, including those not requiring the higher melting rate provided by the disclosed device. For a general understanding of the environment for the system and method disclosed here as well as the details for the system and method, reference is made to the drawings. In the drawings, like reference numerals have been used throughout to designate like elements.

FIG. 1 depicts an imaging apparatus, or at least a portion of an imaging apparatus, 10 in which elements pertinent to the present disclosure are shown. In the embodiment shown, the imaging apparatus 10 implements a solid ink print process for printing onto a continuous media web. To this end, the imaging device 10 includes a web supply and handling system 60, a phase change ink printing system 16, and a web heating system. Although the solid ink melting device and method are described below with reference to the imaging system depicted in FIG. 1, the solid ink melting device and method may be used in any solid ink imaging apparatus that melts solid ink to produce liquid ink for ejection onto an image substrate.

As shown in FIG. 1, the phase change ink printing system includes a web supply and handling system 60, a print head assembly 14, a web heating system, and a fixing assembly 50. The web supply and handling system 60 may include one or more media supply rolls 38 for supplying a media web 20 to the imaging device. The supply and handling system is configured to feed the media web in a known manner along a media pathway in the imaging device through the print zone 18, past the web heating system, and through the fixing assembly 50. To this end, the supply and handling system 60 may include any suitable device 64, such as drive rollers, idler rollers, tensioning bars, etc., for moving the media web through the imaging device. The system may include a take-up roll (not shown) for receiving the media web 20 after printing operations have been performed. Alternatively, the media web 20 may be fed to a cutting device (not shown) as is known in the art for cutting the media web into discrete sheets.

The print head assembly 14 is appropriately supported to eject drops of ink directly onto the media web 20 as the web moves through the print zone 18. In other solid ink imaging systems in which the melting device and method may be used, the print head assembly 14 may be configured to eject drops onto an intermediate transfer member (not shown), such as a drum or belt, for subsequent transfer to a media web or media sheets. The print head assembly 14 may be incorporated into either a carriage type printer, a partial width array type printer, or a page-width type printer, and may include one or more print heads. As illustrated, the print head assembly includes a plurality of print heads arranged to print full color images comprised of the colors cyan, magenta, yellow, and black. Within each print head, a plurality of inkjets is arranged in a row and column fashion. Each of the inkjets is coupled to a source of liquid ink and each one ejects ink through an inkjet nozzle in response to a firing signal being received by an inkjet actuator, such as a piezoelectric actuator, in the inkjet.

In the printing system shown in FIG. 1, ink is supplied to the print head assembly 14 from a solid ink supply 24. As the phase change ink imaging device 10 is a multicolor device, the ink supply 24 includes four sources 28, 30, 32, and 34, of melted ink for the four different colors CYMK (cyan, yellow, magenta, black) of phase change ink solid ink. The phase change ink system 24 also includes a solid phase change ink melting and control assembly or apparatus (FIG. 2) for melting or phase changing the solid form of the phase change ink into a liquid form, and then supplying the liquid ink to the print head assembly 14.

Once the drops of ink have been ejected by the print head assembly onto the moving web to form an image, the web is moved through a fixing assembly 50 for fixing the emitted ink drops, or image, to the web. In the embodiment of FIG. 1, the fixing assembly 50 comprises at least one pair of fixing rollers 54 that are positioned in relation to each other to form a nip through which the media web is fed. The ink drops on the media web are pressed into the web and spread out on the web by the pressure formed by the nip. Although the fixing assembly 50 is depicted as a pair of fixing rollers, the fixing assembly may be any suitable type of device or apparatus, as is known in the art, which is capable of fixing an ink image onto the media.

Operation and control of the various subsystems, components and functions of the device 10 are performed with the aid of a controller 40. The controller 40 may be a processor configured to control the operation of the melting device as described in more detail below. The controller may be a general purpose processor having an associated memory in which programmed instructions are stored. Execution of the programmed instructions enables the controller to monitor the temperature of the melting device and to turn on and off the rotating members within the melting device that shear and compress the solid ink pellets against the heated gear tooth surfaces. The controller for the melting device need not be the overall system controller, but instead may be an application specific integrated circuit or a group of electronic components configured on a printed circuit for operation of the melting device. Thus, the controller may be implemented in hardware alone, software alone, or a combination of hardware and software. In one embodiment, the controller 40 comprises a self-contained, microcomputer having a central processor unit (not shown) and electronic storage (not shown). The electronic storage may be a non-volatile memory, such as a read only memory (ROM) or a programmable non-volatile memory, such as an EEPROM or flash memory. The controller 40 is configured to regulate the production of melted ink in a manner that keeps the print heads of assembly 14 supplied with liquid ink.

Figure 2:
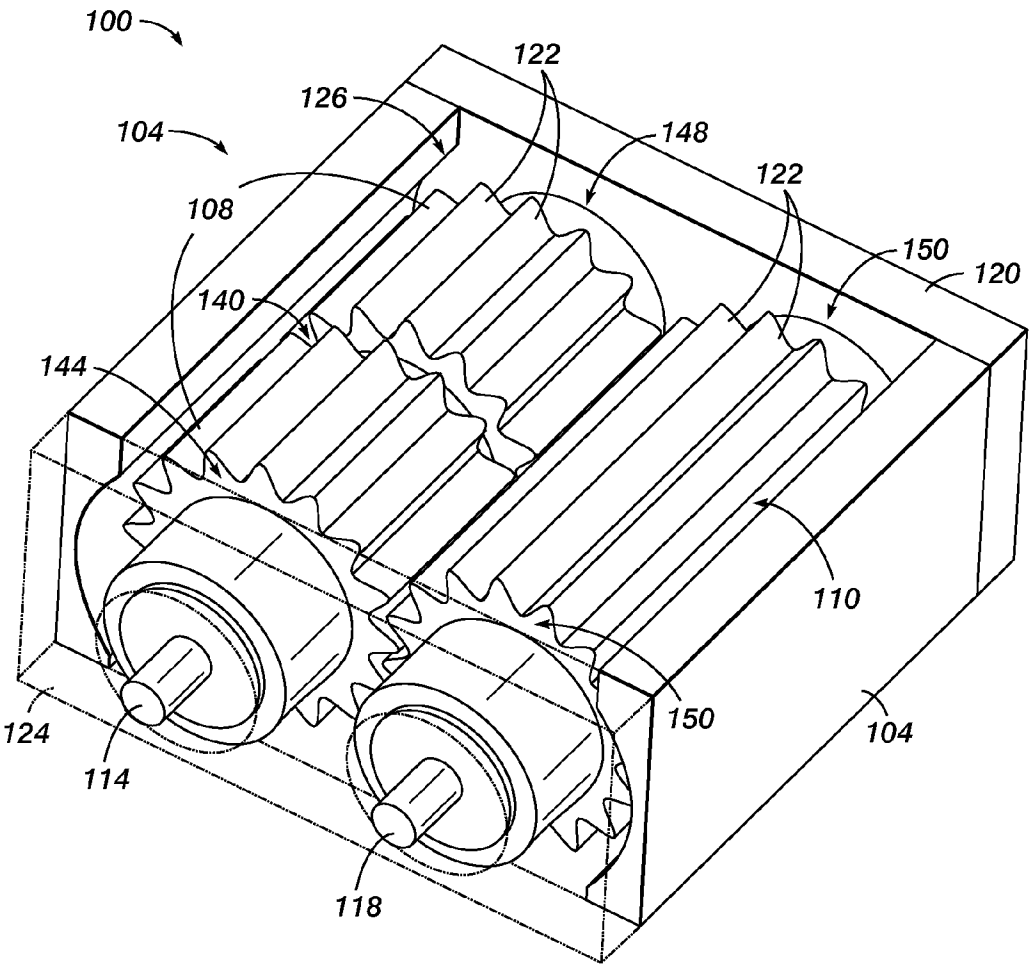
FIG. 2 is a perspective view of a melting device that both shears and melts solid ink in the printer shown in FIG. 1.

As shown in FIG. 2, an exemplary melting device 100 includes a housing 104, two rotatable members 108 and 110, and two heating elements 114 and 118. The housing 104 and the rotatable members 108, 110 in one embodiment are constructed from aluminum, although other metals may be used. Other materials may be used for the rotatable members 108 and 110 provided they are good thermal conductors of heat to the solid ink provided to the rotatable members, are sufficiently rigid to support shearing structures in their surfaces, and can apply shear and compression forces to the solid ink pellets melting between the two rotatable members. Both ends of each of the rotatable members 108 and 110 are closed with Viton quad seals, which provided a better friction fit about the bearings around which the members rotate than O-seals or the like. The heaters may be inserted within the rotatable members and may include halogen quartz heaters, electrical resistive heaters, or high radiant flux mica heaters, or the like. Other types of heaters may be used provided they are capable of heating relatively quickly the rotatable members to temperatures that melt solid ink.

Inductive heaters may be used to heat the rotatable members. Although such heaters are more expensive than the convective type heaters described above, inductive heaters are capable of heating the rotatable members to a melting temperature within 3-5 seconds. To provide an inductive heater, a stainless steel sleeve needs to be sweat fitted within each rotatable aluminum member. Sweat fitting is a reference to a method in which a heated part and a cooled part are fitted together and then allowed to dissipate the relative energy differences between the two parts. To ensure the resulting fit remains secure throughout the range of operational temperatures, the relative thicknesses of the parts and the temperatures to which the parts are heated or cooled are determined through empirical testing. After the stainless steel sleeve is fitted within the rotatable member, a conductive coil, such as a copper coil, is positioned within the member. The conductive coil is positioned close to the sleeve to enable changing magnetic flux lines emanating from the coil to cut the sleeve. The fluctuating magnetic field is generated by passing an alternating current through the conductive coil. The fluctuating magnetic flux lines heat the sleeve, which, in turn, heats the rotatable member in which the sleeve is fitted. The geometry of the conductive coil is experimentally determined. A stainless steel sleeve having a thickness of approximately 20 thousandths of an inch and a copper coil operatively coupled to an alternating current source that provides a current of approximately 4 amps at a frequency in the range of about 20 KHz to about 40 KHz is thought adequate for many applications.

In more detail, the rotatable members 108 and 110 are hollow cylindrical structures that are mounted about drive shafts, although other shapes may be used provided that they are able to cooperate with one another to melt and shear solid ink as the solid ink passes between the two rotating members. The drive shafts extend outwardly from wall 120 of the housing 104 and, thus, cannot be seen in FIG. 2. The drive shafts are mounted within Viton quad seals and journal bearings in the wall 120 so the members are able to rotate in response to the drive shafts being driven by an actuator. The electrical leads (not shown) for the heaters 114 and 118 extend from wall 124 for coupling to a power supply. The power supply is selectively coupled to the heaters by a controller, as discussed below, to regulate the heat generated by the heaters. While the embodiment shown in FIG. 2 enables the heaters to be accessed from one end of the rotatable members and the drive shafts extend from the other end, other arrangements may be used.

Formed in the external surfaces of the rotatable members are teeth 122. These teeth may be longitudinal and extend the entire length of each rotatable member. Alternatively, each tooth may be a raised protrusion that encircles the circumference of a rotatable member. In embodiment shown in FIG. 2, however, the teeth on member 108 are interrupted by three grooves 140, 144, and 148. The teeth on member 110 are interrupted by a single groove 150, although member 110 may be formed with grooves in the same position as they shown for member 108. In one embodiment, grooves 144 and 148 are located between the center groove 140 and the ends of the member 108 and are narrower than the center groove 140. In one embodiment, the groove 150 is narrower than the groove 140, although the two grooves may have the width. All of the grooves shown in FIG. 2 are V-shaped grooves, although other groove geometries may be used. These grooves enable the melted ink to flow past the members 108 and 110 and drain away from the rotating members. The center groove 140 is larger than the other grooves to enable the center flow to have a greater volume than the flows at grooves 144 and 148. This arrangement helps the collection of melted ink to be greater in the central area of the melting device. The grooves 144 and 148 help reduce the likelihood that melted ink pools at the ends of the rotating members and possibly rise over the wall 120. In one embodiment, the groove 140 is approximately 5 mm in width while the grooves 144, 148, and 150 are approximately 3 mm in width. Other groove arrangements and widths may be used.

The two rotatable members 108 and 110 may be mounted proximate to one another so the fins or side walls of the teeth intermesh with the teeth of the other rotatable member. This type of operation enables the teeth to shear and compress solid ink as the solid ink melts in the meshing zone within the two rotatable members. The intermeshing teeth also enable the teeth to remain spatially separated from one another to help increase the operational life of the rotatable members. The gear teeth sliding surfaces help shear and compress the solid ink pellets to maximize the surface area and thermal conductivity arising from contact between the solid ink pellets in the meshing zone and the two rotatable members. This interaction helps raise the particle temperature and provide sufficient energy for the heat of fusion. In one embodiment, this process uses roughly 1200 watts at a flow rate of approximately 210 gm/minute.

Although the arrangement of components shown in FIG. 2 shows the two rotatable members 108 and 110 in a horizontal configuration, other arrangements may be used. For example, the two rotatable members 108 and 110 may be oriented vertically and the solid ink delivered through an opening in a side wall of the housing 104. In such an arrangement, the melted ink egresses from the meshing zone and drains downwardly along the length of the rotatable members to a collecting area. Alternatively or additionally, a wiper or directed pneumatic force may be provided to sweep the side of the meshing zone from which the melted ink emerges on a periodic basis to assist the gravity-influenced flow of melted ink. The melting device may be tilted slightly to bias the flow of melted ink towards one end of the device as well.

In the embodiment shown in FIG. 2, the housing 104 has an opening 126 over the two rotatable members 108 and 110. Solid ink is directed through this opening towards the meshing zone between the two rotatable members. Preferably, the solid ink is in the form of micro-pellets or flat-bottomed shaped drops. These solid ink pellets or drops have a diameter that is approximately 0.7 mm±3 mm, although other shapes and sizes may be used depending upon the length and diameter of the rotating members. The particular embodiment illustrated in the figures and described herein has been designed a melted ink flow rate versus heat and particle size to minimize the energy required for both latent heat and heat of fusion requirements.

In other embodiments, solid ink sticks may be fed to a grinding device constructed in accordance with the principles discussed above. In these embodiments, a first set of heated, rotatable members are separated by a greater distance to shear chips from the exterior of a solid ink stick in the meshing zone, and a second set of heated, rotatable members are positioned below the first set to receive the chips from the first set of members. In this embodiment, the first set of rotatable members is heated to release the chips from the members so the chips move to the second set of rotatable members. The second set of heated, rotatable members then shears, compresses, and melts the chips as described above. Once the melting and shearing of a stick commences, the process continues melting and shearing the ink sticks as long as they are delivered to the melting device. Alternatively, a pair of rotatable members, each member having a smooth exterior surface, may receive a solid ink stick. The two members are positioned from one another to provide a gap between them as they rotate and support the solid ink stick. The melted ink drips between the two members as the stick melts against the heated surfaces of the rotatable members. The gap between the two rotatable members is sized to reduce the likelihood that a sliver of solid ink slips past the two members. Once the melting of a stick commences, the process continues melting ink sticks as long as they are delivered to the melting device.

Figure 3:
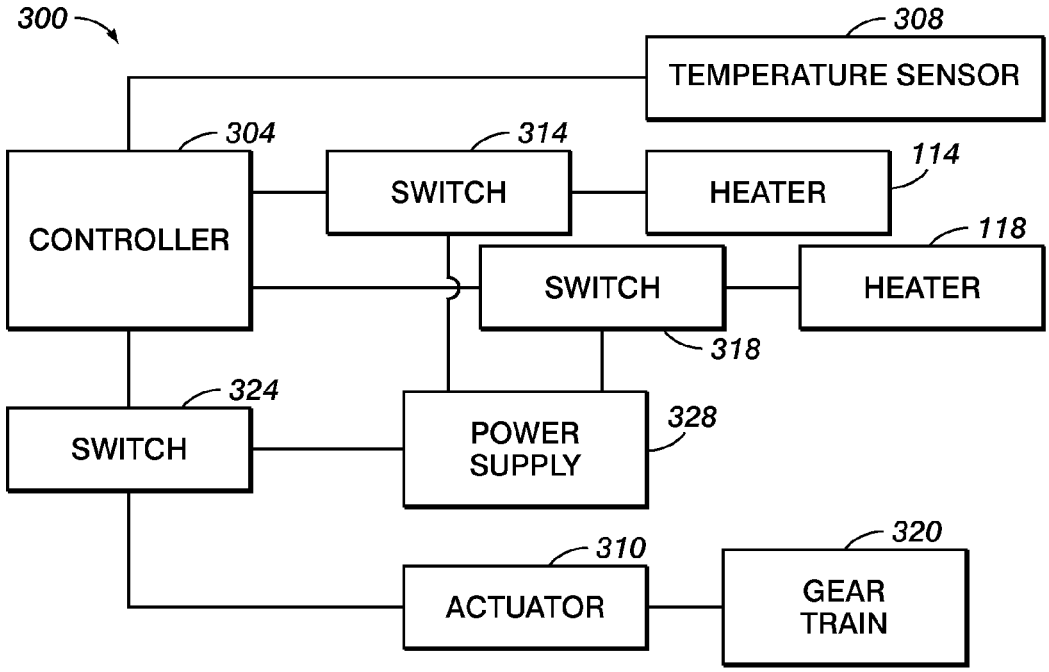
FIG. 3 is a block diagram of a system for controlling operation of the melting device shown in FIG. 2.

A block diagram of a system for controlling operation of the melting device is shown in FIG. 3. The system 300 includes a controller 304 that is electrically coupled to a temperature sensor 308, and the switches 314, 318, and 324. The controller 304 generates a signal that enables the switch 324 to couple and decouple an actuator 310 to a power supply 328. The actuator 310 in one embodiment is an electrical motor having a rotating output shaft. The electrical motor may be a direct current (DC) or an alternating current (AC) motor. In one embodiment, an AC synchronous motor is coupled to the switch 324 for control by controller 304 and the rotating output shaft of the motor is coupled to the drive shafts of the rotatable members 108 and 110 through a gear train 320. In response to a signal indicating melted ink is required for the melted ink supply, the controller 304 generates a signal that couples the motor 310 to the power supply 328 through switch 324 to enable the rotating output shaft to rotate. The gear train responds to the rotation of the output shaft by rotating the drive shafts for the rotatable members 108 and 110. The gear train may be comprised of one or more gears coupled to the rotational output of the motor, which may be bidirectional. The gears may be employed to attain an appropriate speed range for the rotation of the rotatable members and the torque generated by the members 114 and 118. Additionally, the gears may be used to change the direction of the rotation input by the motor.

With further reference to FIG. 3, the controller generates signals to switches 314 and 318 to couple the heaters 114 and 118, respectively, to the power supply 328 to enable the heaters to heat the rotatable members 108 and 110. The controller receives an electrical signal from the temperature sensor 308 and the controller compares the signal to a temperature threshold. In response to the temperature being above the threshold, the controller decouples the heaters from the power supply. As long as the temperature is below the threshold, the controller continues to couple the heaters to the power supply to heat the two rotatable members. The temperature sensor may be a thermistor or other electrical component that generates an electrical signal indicative of the temperature of the ambient air about the component. The temperature sensor may be mounted within one of the rotatable members or on one of the walls of the housing 104.

The system 300 enables the melting device to self-regulate. As long as the heaters are operating, the rotatable members reach a temperature that melts the solid ink even without rotation occurring. Thus, should too much solid ink enter the meshing zone and the rotatable members cease rotating, the exterior of the solid ink eventually reaches a melting temperature and begins to liquefy. As the solid ink melts, the continued exertion of the motor and gear train on the drive shafts overcomes the resistance of the solid ink and shearing of the solid ink begins. A current sensor is used to regulated the pellet mass flow rate into the meshing zone.

Figure 4:
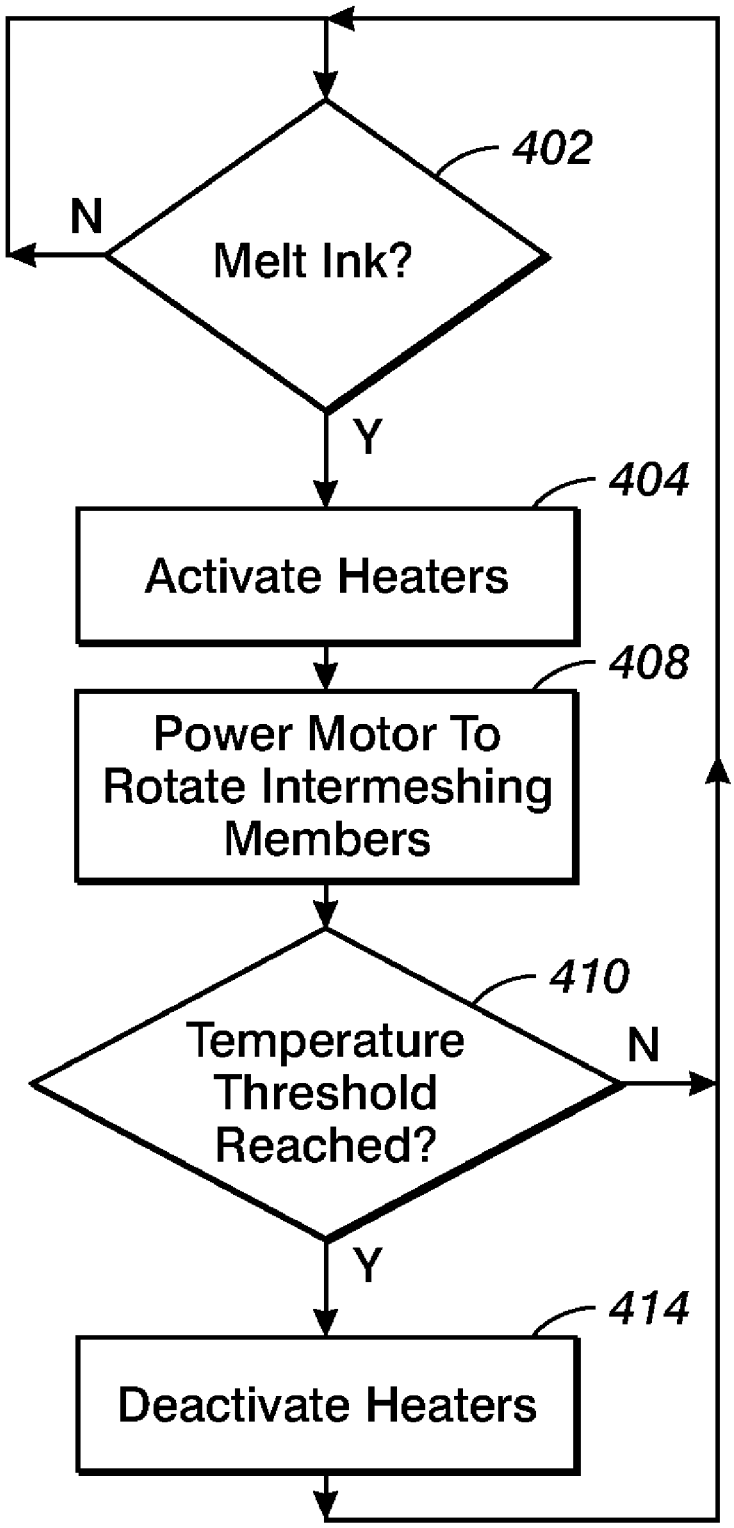
FIG. 4 is a flow diagram of a process that may be implemented by the controller shown in FIG. 3.

A process that may be implemented by the controller 304 to melt solid ink is shown in FIG. 4. In response to a signal to generate melted ink (block 402), the controller couples one or more heaters to a power supply to heat the two intermeshing members to a solid ink melting temperature (block 404). Otherwise, the controller waits for the signal indicating melted ink is required. The controller also selectively couples a motor to a power supply to rotate two intermeshing members (block 408). As solid ink flows into a meshing zone formed between the two rotating intermeshing members, the controller samples the signal from the temperature sensor to determine whether the temperature threshold has been reached (block 410). If it is reached, the controller deactivates the heaters (block 414) and continues to check whether the signal for generating melted ink is still active. As long as the temperature threshold has not been reached, the processor continues to rotate and heat the two intermeshing members until the signal for generating melted ink is terminated (block 402).

In operation, a melting device is located in a solid ink printer for each feed channel of the printer. A melted ink reservoir is positioned proximate each melting device to receive melted ink. The melted ink reservoirs are coupled to the appropriate print heads that eject the color ink contained within a melted reservoir. After the feed channels are loaded with solid ink and a signal indicating melted ink of a particular color is to be generated, the corresponding melting device begins to heat and rotate the rotatable members within the housing of the melting device to produce melted ink that is fed into the respective melted ink reservoir for the melting device.

Those skilled in the art will recognize that numerous modifications can be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed:

1. A solid ink printer comprising:

a print head that ejects melted ink;

a web of image substrate that moves past the print head to receive melted ink ejected from the print head;

a pair of fixing rollers positioned downstream of the print head, the fixing rollers forming a nip through which the web of image substrate passes to fix the ink onto the web of image substrate; and a melting device coupled to the print head to provide melted ink to the print head, the melting device comprising:

a housing having an opening to receive solid ink;

a first rotatable member mounted within the housing;

a second rotatable member mounted within the housing, the second rotatable member being proximate to, but spatially separated from the first rotatable member mounted within the melting housing, a heater located within the first rotatable member to heat the first rotatable member to a temperature at which the solid ink melts; and a motor coupled to the first rotatable member and the second rotatable member to rotate the first rotatable member and the second rotatable member within the housing to shear the solid ink as the solid ink melts against the heated first rotatable member.

2. The printer of claim 1 further comprising:

a heater mounted within the second rotatable member to heat the second rotatable member to the temperature at which the solid ink melts.

3. The printer of claim 2 wherein the first rotatable member is a cylinder having teeth in a surface of the cylinder; and the second rotatable member is a second cylinder having teeth in a surface of the second cylinder.

4. The printer of claim 3 wherein the teeth of the cylinder for the first rotatable member and the teeth of the second cylinder intermesh with one another.

5. The printer of claim 4 wherein the teeth of the cylinder for the first rotatable member and the teeth of the second cylinder are arranged longitudinally on the surfaces of the first rotatable member and the second rotatable member.

6. The printer of claim 4 wherein the teeth of the cylinder for the first rotatable member and the teeth of the second cylinder are arranged circumferentially on the surfaces of the first rotatable member and the second rotatable member.

7. The printer of claim 2 wherein the heater in the first rotatable member and the heater in the second rotatable member are electrical resistive heaters.

8. A solid ink melting device for use in a solid ink printer comprising:

a housing having an opening to receive solid ink;

a first rotatable member mounted within the housing having a plurality of teeth;

a second rotatable member having a plurality of teeth, the second rotatable member being mounted within the housing, parallel and proximate to, but spatially separated from, the first rotatable member, and configured to enable the teeth of the second rotatable member to intermesh with the teeth of the first rotatable member;

a heater that heats the first rotatable member to a temperature at which solid ink melts; and a motor coupled to the first rotatable member and the second rotatable member to rotate the first rotatable member and second rotatable member within the housing to shear the solid ink as the solid ink melts against the heated first rotatable member.

9. The melting device of claim 8 wherein the first and the second rotatable members are arranged horizontally with reference to a plane of the opening in the housing.

10. The melting device of claim 8 wherein the first and the second rotatable members are arranged vertically with reference to a plane of the opening in the housing.

11. The melting device of claim 8 wherein the heater is located within the first rotatable member; and the second rotatable member includes a second heater located within the second rotatable member to heat the second rotatable member to a temperature at which solid ink melts.

12. The melting device of claim 8 wherein the heater is a halogen quartz lamp.

13. The melting device of claim 8 wherein the motor is an alternating current (AC) synchronous motor having a rotating output shaft; and a gear train couples the output shaft of the AC synchronous motor to the first and the second rotatable members.

14. A solid ink melting device for use in a solid ink printer comprising:

a housing having an opening to receive solid ink;

a first rotatable member mounted within the housing;

a halogen quartz lamp that heats the first rotatable member to a temperature at which the solid ink melts; and a motor coupled to the first rotatable member to rotate the rotatable member within the housing to shear the solid ink as the solid ink melts against the heated first rotatable member.

15. The melting device of claim 14 further comprising:

a second rotatable member mounted proximate to, but spatially separated from the first rotatable member mounted within the housing; and the motor being coupled to the second rotatable member to move the second rotatable member within the housing to cooperate with the movement of the first rotatable member and assist in the shearing of the solid ink as the solid ink melts within the housing.

16. The melting device of claim 15, the first rotatable member and the second rotatable member being parallel to one another in the melting housing.

17. The melting device of claim 16, the first rotatable member having a plurality of teeth and the second rotatable member having a plurality of teeth.

18. The melting device of claim 17, the first and the second rotatable members being configured to intermesh the teeth of the first rotatable member with the teeth of the second rotatable member.

19. The melting device of claim 15 wherein the first and the second rotatable members are arranged horizontally with reference to a plane of the opening in the housing.

20. The melting device of claim 15 wherein the first and the second rotatable members are arranged vertically with reference to a plane of the opening in the housing.

21. The melting device of claim 15 wherein the halogen quartz lamp is located within the first rotatable member; and the second rotatable member includes a second halogen quartz lamp located within the second rotatable member to heat the second rotatable member to a temperature at which the solid ink melts.

22. The melting device of claim 15 wherein the motor is an alternating current (AC) synchronous motor having a rotating output shaft; and a gear train couples the output shaft of the AC synchronous motor to the first and the second rotatable members.

* * * * *